US011988000B2

(12) United States Patent
Cramer

(10) Patent No.: US 11,988,000 B2
(45) Date of Patent: May 21, 2024

(54) TILT-FORM BRACKET FOR CONCRETE WALL CONSTRUCTION

(71) Applicant: OCM, Inc., Grayslake, IL (US)

(72) Inventor: Andy Cramer, Johnsburg, IL (US)

(73) Assignee: OCM, Inc., Grayslake, IL (US)

( * ) Notice: Subject to any disclaimer, the term of this patent is extended or adjusted under 35 U.S.C. 154(b) by 217 days.

(21) Appl. No.: 17/563,494

(22) Filed: Dec. 28, 2021

(65) Prior Publication Data

US 2023/0203827 A1 Jun. 29, 2023

(51) Int. Cl.
*E04G 17/14* (2006.01)

(52) U.S. Cl.
CPC ..... *E04G 17/14* (2013.01)

(58) Field of Classification Search
CPC ..... E04G 17/14; E04G 13/00; B28B 7/0014; B28B 7/0017; B28B 7/002; B28B 7/0023; B28B 7/0026; B28B 2007/0052
See application file for complete search history.

(56) References Cited

U.S. PATENT DOCUMENTS 1,722,144 A 7/1929 Heltzel
1,944,511 A 1/1934 Heltzel
3,071,835 A * 1/1963 Tumey ..... B28B 7/0014 425/DIG. 129
4,101,111 A * 7/1978 Bishop ..... B28B 7/0017 248/351
4,846,437 A 7/1989 Fitzgerald
5,766,645 A * 6/1998 Kaminski ..... B28B 7/0017 249/126
5,817,247 A 10/1998 Colatruglio
5,843,327 A * 12/1998 Lindgren ..... E04G 17/14 249/219.1
6,540,201 B1 4/2003 Gagnon et al.
8,186,645 B2 5/2012 Shaw et al.
11,761,219 B2 * 9/2023 Hansort ..... E01C 19/502 52/699
2002/0145093 A1 * 10/2002 Shaw ..... E04G 13/00 248/235
2004/0007652 A1 * 1/2004 Shaw ..... E04G 13/00 248/351

(Continued)

FOREIGN PATENT DOCUMENTS

CA 2370896 A1 * 8/2002 ..... B28B 7/0014
CN 106079043 A * 11/2016 ..... B28B 7/0002
DE 202012008220 U1 * 5/2013 ..... E04G 11/365

(Continued)

OTHER PUBLICATIONS

Dayton Superior,T66 Tilt Bracket, Technical Data Sheet, Nov. 1, 2021, 3 pages, Dayton Superior Corporation, Miamisburg, OH, USA.

(Continued)

*Primary Examiner* — Christine T Cajilig
(74) *Attorney, Agent, or Firm* — Liell & McNeil

(57) ABSTRACT

A tilt-form bracket for tilt up concrete wall construction includes a triangle brace piece that is mated atop a shoe plate piece for thinner wall construction. An optional height extension piece may be mounted atop the triangle brace piece for thicker wall construction. The triangle brace piece may include a pair of spaced apart triangle braces separated by a vertical wall that defines a form connection through hole.

20 Claims, 4 Drawing Sheets

(56) References Cited

U.S. PATENT DOCUMENTS

| | | | | |
|---|---|---|---|---|
| 2004/0035083 | A1* | 2/2004 | Takagi | E04G 13/00 52/712 |
| 2006/0016956 | A1* | 1/2006 | Bennett | E04G 17/14 249/219.1 |

FOREIGN PATENT DOCUMENTS

| | | | | |
|---|---|---|---|---|
| DE | 202020102659 | U1 * | 7/2020 | B28B 7/0017 |
| EP | 945238 | A2 * | 9/1999 | B28B 7/0017 |
| EP | 1672141 | A1 * | 6/2006 | E04C 5/20 |
| EP | 2641713 | A2 * | 9/2013 | B28B 7/0017 |
| EP | 2944742 | B1 * | 8/2017 | E04G 11/36 |
| FR | 2552259 | A1 * | 3/1985 | B28B 7/0017 |
| GB | 172354 | A * | 11/1921 | B28B 7/0014 |
| KR | 200442545 | Y1 * | 11/2008 | E04G 17/14 |
| KR | 100979264 | B1 * | 8/2010 | E04G 17/14 |
| WO | WO-8810348 | A1 * | 12/1988 | E04G 17/14 |
| WO | WO-0196690 | A1 * | 12/2001 | E04G 13/00 |
| WO | WO-2008058313 | A1 * | 5/2008 | B28B 7/0017 |
| WO | WO-2014096980 | A1 * | 6/2014 | B28B 7/0017 |
| WO | WO-2015101719 | A1 * | 7/2015 | B28B 7/0014 |

OTHER PUBLICATIONS

Surebuilt, Edge Form Bracket, Concrete Forms and Accessories, www.surebuilt-usa.com, Nov. 1, 2021, 2 pages, SureBuilt, USA.

* cited by examiner

TILT-FORM BRACKET FOR CONCRETE WALL CONSTRUCTION

TECHNICAL FIELD

The present disclosure relates generally to brackets for tilt-up concrete wall construction, and more particularly to versatile multipiece tilt form bracket.

BACKGROUND

In tilt up concrete wall construction, the wall is formed in a horizontal position, typically atop a slab. After the concrete dries, the form is dismantled, and the wall is tilted up vertically and placed in its desired position as part of a building. The form for the wall construction often utilizes dimensional lumber that is held in place with brackets that may be connected to the lumber with screw type fasteners. Except for unusual circumstances, tilt up concrete walls are usually made in either a five or seven inch thickness. Existing brackets for tilt up construction suffer from a number of drawbacks, including a necessity to inventory brackets for both the thinner and thicker concrete walls. Currently available brackets may also lack in stiffness, thus requiring larger numbers of brackets for a given wall construction project, with increasing labor and supply costs.

The present disclosure is directed toward one or more of the problems set forth above.

SUMMARY

In one aspect, a tilt-form bracket for tilt up concrete wall construction includes a one-piece plastic shoe plate having a slab contact surface opposite to a brace mating surface that includes a pair of spaced apart parallel mating grooves. A one-piece plastic dual triangle brace includes a plate mating surface and a height extension mating surface. The plate mating surface includes a pair of spaced apart parallel triangular braces separated by a vertical wall that defines a form connection through hole. The plate mating surface of the dual triangle brace mates with the brace mating surface of the shoe plate in exactly one configuration with each of the pair of spaced apart parallel triangular braces received in a respective one of the pair of spaced apart parallel mating grooves.

In another aspect, a tilt-form bracket for tilt up concrete wall construction consists of exactly three pieces, which are a shoe plate piece, a triangle brace piece that defines three form connection through holes, and a height extension piece that defines one form connection through hole. The triangle brace piece is mounted on the shoe plate piece, and the height extension piece is mounted atop the triangle brace piece.

DETAILED DESCRIPTION

Figure 1:
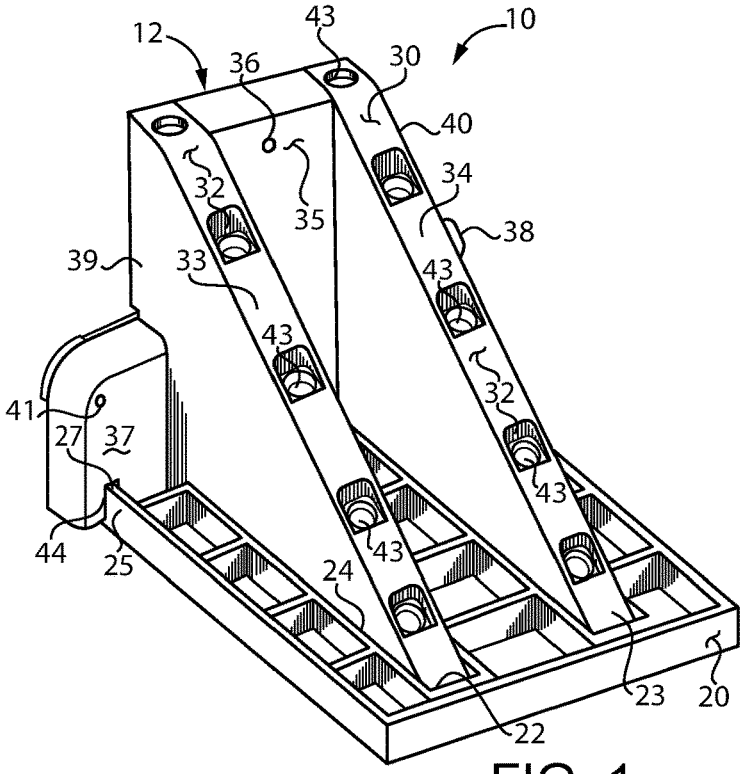
FIG. 1 is a perspective view of a tilt-form bracket in a thin wall configuration.
Figure 2:
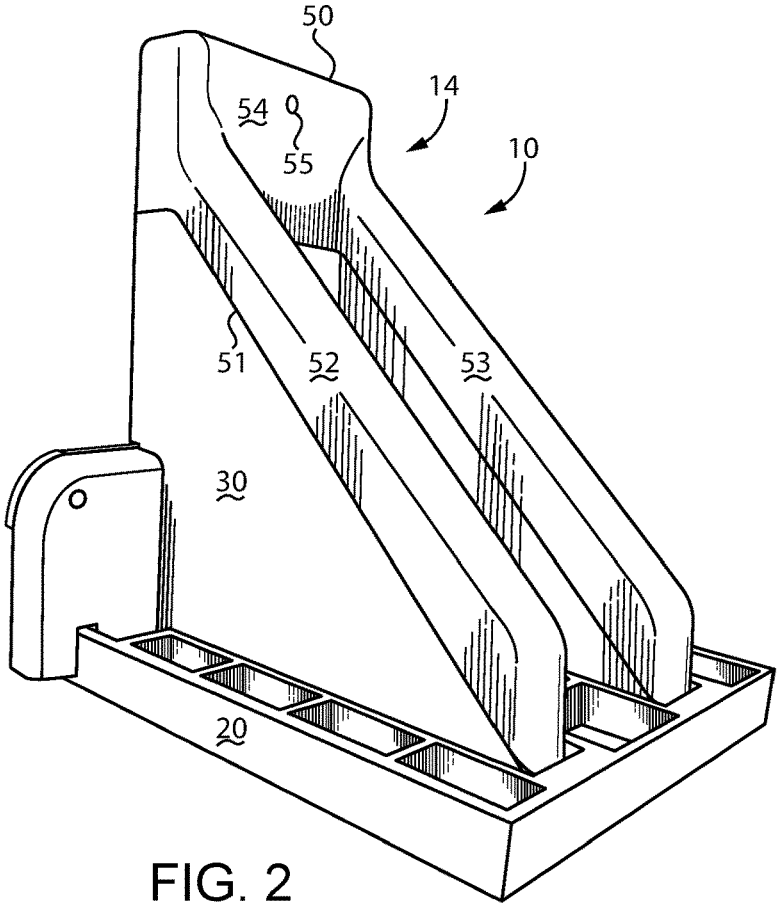
FIG. 2 is a perspective view of a tilt-form bracket in a thick wall configuration.
Figure 3:
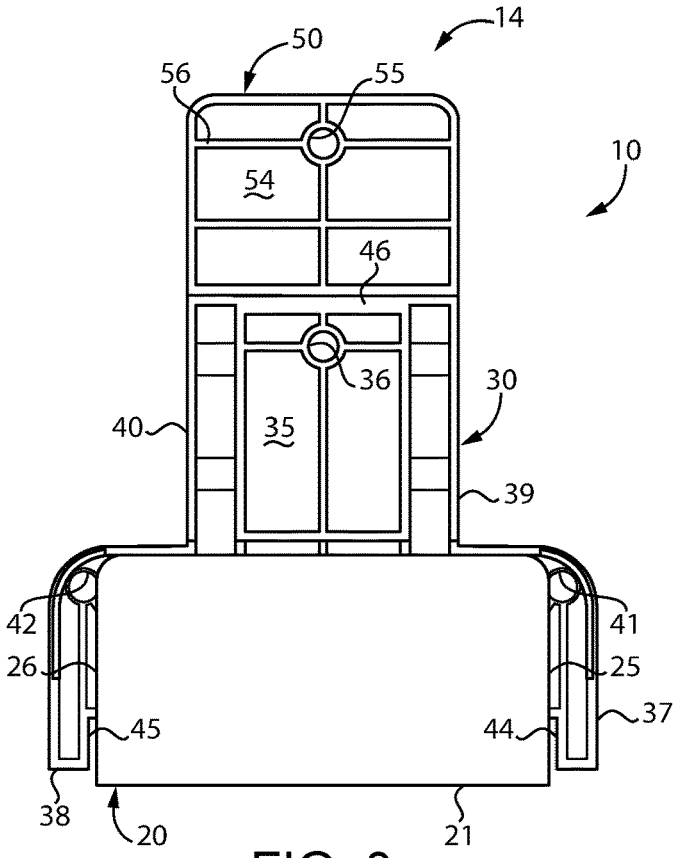
FIG. 3 is a back side view of the tilt-form bracket of FIG. 2.
Figure 4:
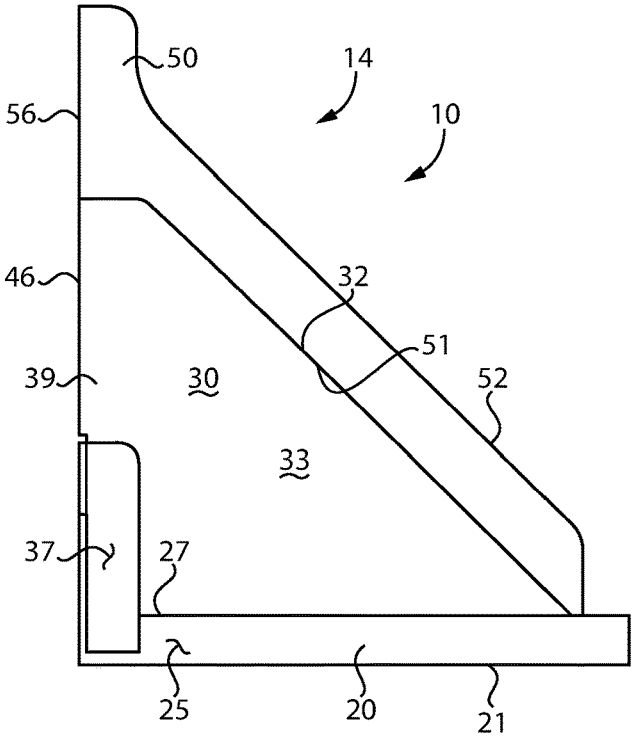
FIG. 4 is a left side view of the tilt-form bracket of FIG. 3.
Figure 5:
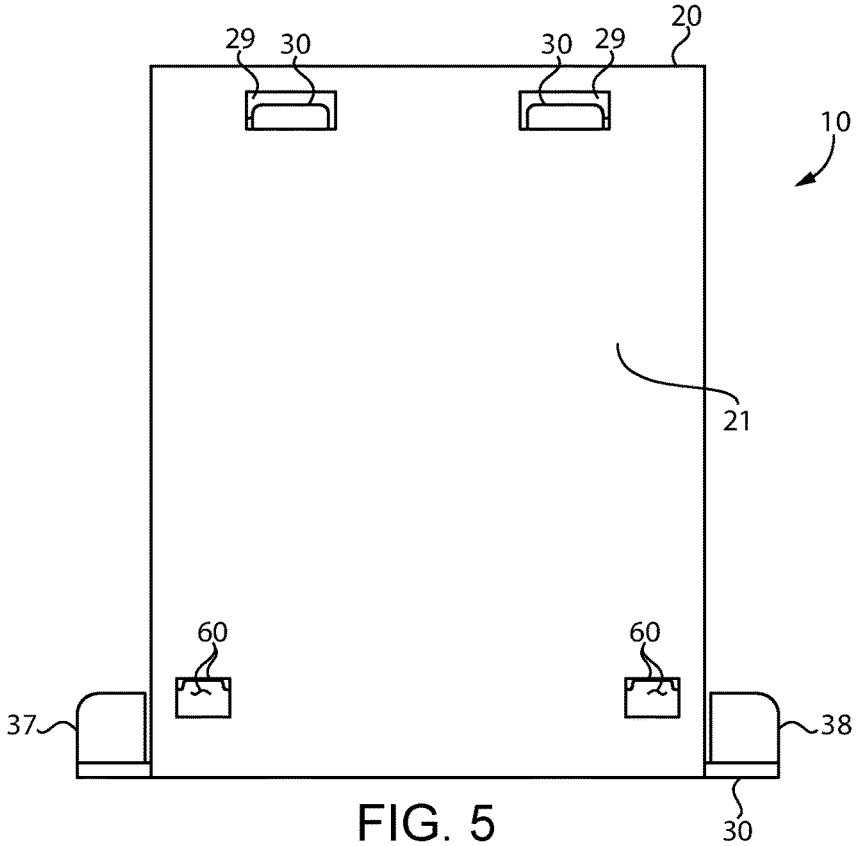
FIG. 5 is a bottom side view of the tilt-form bracket of either FIG. 1 or FIG. 2.
Figure 6:
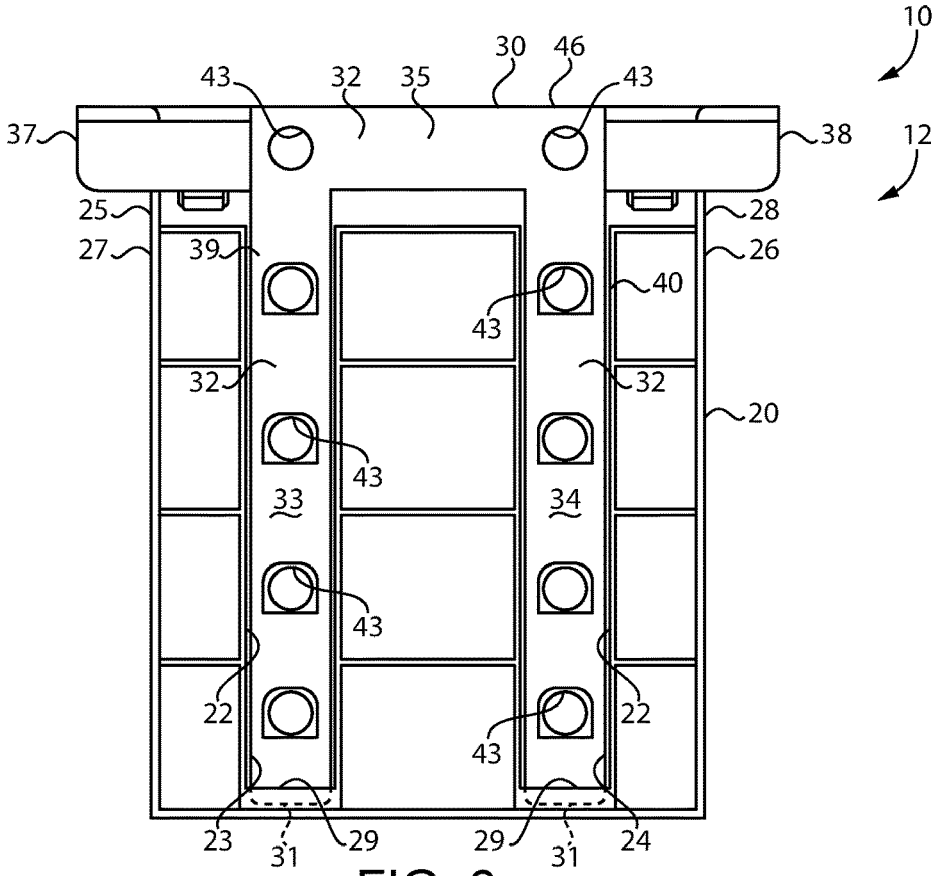
FIG. 6 is a top side view of the tilt-form bracket of FIG. 1.
Figure 7:
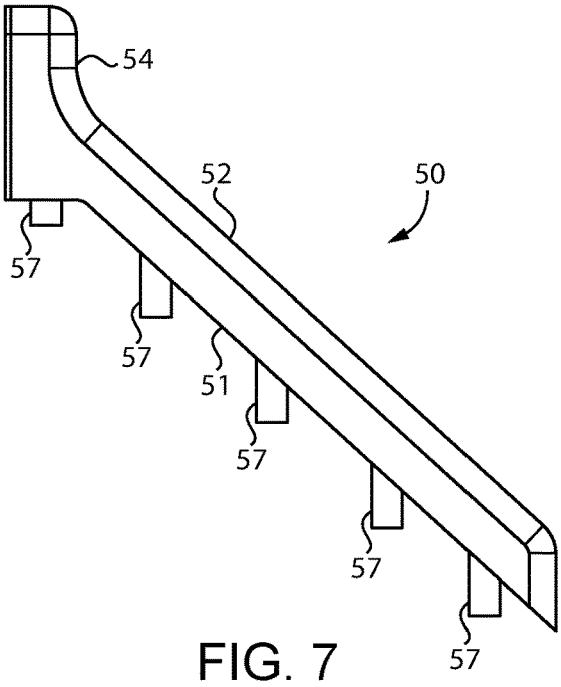
FIG. 7 is a side view of a height extension piece according to the present disclosure.
Figure 8:
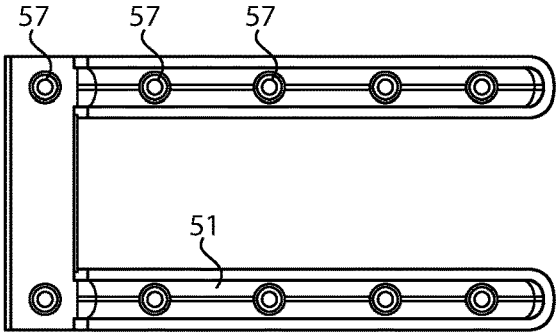
FIG. 8 is a bottom view of the height extension piece of FIG. 7.
Figure 9:
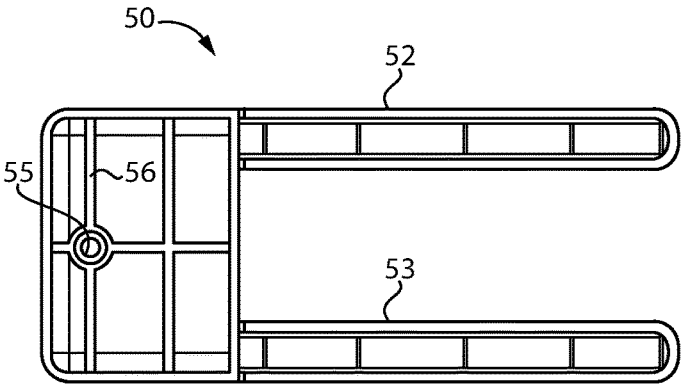
FIG. 9 is a back side view of the height extension piece of FIGS. 7 and 8.

Referring initially to FIGS. 1 and 2, A tilt-form bracket 10 may assume a thin wall configuration 12 or a thick wall configuration 14. Although not necessary, the thin wall configuration 12 may correspond to five inch thick tilt up concrete wall construction, and the thick wall configuration 14 may correspond to seven inch thick tilt up concrete wall construction, as is typical in the industry. Both configurations 12 and 14 include a one-piece plastic shoe plate 20 that is preferably formed from a suitable molded plastic to include a slab contact surface 21 opposite to a brace mating surface 22 that includes a pair of spaced apart parallel mating grooves 23 and 24. As used in this disclosure, the term "one-piece" means an integral body that is made up of exactly one body, such as a single piece of molded plastic. A one-piece plastic dual triangle brace 30 includes a plate mating surface 31 and a height extension mating surface 32. The plate mating surface 31 includes the undersides of a pair of spaced apart parallel triangular braces 33 and 34 that are separated by a vertical wall 35 that defines a form connection through hole 36. The plate mating surface 31 of the dual triangle brace piece 30 mates with the brace mating surface 22 of the shoe plate piece 20 in exactly one configuration with each of the pair of spaced apart parallel triangular braces 33 and 34 received in a respective one of the pair of spaced apart parallel mating grooves 23 and 24. The plate mating surface 31 includes a pair of tabs (FIGS. 5 and 6) that are captured by respective edges 29 of show plate piece 20, and a snap fit connection 60 where a hook of one piece is captured by a ledge of the other piece to lock the shoe plate piece 20 to the dual triangle brace piece 30.

The dual triangle brace piece 30 may include first and second attachment wings 37 and 38 that flank opposite sides 39 and 40 of the pair of spaced apart parallel triangular braces 33 and 34. Each of the first and second attachment wings 37 and 38 defines a form connection through hole 41 or 42 that is outboard of respective left and right outside edges 25 and 26 of the shoe plate piece 20. Thus, the form connection through holes 41 and 42 are further apart than the outside edges 25 and 26. Each of the first and second attachment wings 37 and 38 may define a locating slot 44 or 45 that receives an upturned edge 27 or 28 of the shoe plate piece 20. The dual triangle brace piece 30 includes a form contact surface 46 that abuts a form piece of dimensional lumber (not shown), which is typically a wood board, when the tilt-form bracket 10 is in use.

When the tilt-form bracket 10 is changed from the thin wall configuration 12 to the thick wall configuration 14, a one-piece plastic height extension 50 is attached atop the dual triangle brace piece 30. The height extension piece 50 includes a brace mating surface 51 and a pair of brace extensions 52 and 53 separated by a wall extension 54 that defines exactly one form connection through hole 55. The brace mating surface 51 of the height extension piece 50 mates in exactly one configuration with the height extension mating surface 32 of the dual triangle brace piece 30. In the illustrated embodiment, brace mating surface 51 includes a plurality of locating dowels 57 that are received in counterpart dowel holes 43 defined in the triangle braces 33, 34 and the vertical wall 35 of dual triangle brace piece 30. Those skilled in the art will appreciate that different mating feature shapes could be substituted for the dowel/hole strategy shown, or the pieces having the holes and dowels could be reversed or mixed without departing from the intended scope of this disclosure. The height extension piece 50 may include its own form contact surface 56.

The thick configuration 14 of the tilt-form bracket 10 may be considered to consist of exactly three pieces: a shoe plate piece 20, a triangle brace piece 30 and a height extension piece 50. The triangle brace piece 30 defines exactly three form connection through holes 36, 41 and 42, and the height extension piece 50 defines exactly one form connection through hole 55. The triangle brace piece 30 is mounted on the shoe plate piece 20, and the height extension piece 50 is mounted atop the triangle brace piece 30. In this aspect, the triangle brace piece 30 may include a pair of spaced apart parallel triangular braces 33 and 34 that are separated by a vertical wall 35.

INDUSTRIAL APPLICABILITY

The tilt-form bracket 10 of the present disclosure finds application in bracing forms when pouring concrete in tilt up concrete wall construction applications. Different configurations 12 and 14 of the tilt-form bracket can be used for thin (maybe five inches) and thick (maybe seven inches) concrete walls. The present disclosure finds particular application for builders and suppliers that have a need to inventory parts suitable for both thin and thick wall construction applications.

After choosing a wall thickness, a practitioner selects a number of braces necessary to support the form lumber that outlines a given wall. The braces are assembled from individual pieces and attached to the form lumber with suitable fasteners, such as screws that penetrate the individual form connection though holes and thread into the form lumber when the lumber and shoe plate piece 20 are in contact with a slab onto which the concrete is poured. After the concrete dries, the forms are disconnected and the wall is tilted vertical and moved into place at the construction site. The individual tilt-form braces may be detached from the lumber forms for reuse, recycled or discarded. The dual triangle structure of the tilt-form bracket may allow for a lesser number of braces in a given job than prior art single triangle braces, thus saving labor and other costs. The optional height extension piece 50 permits builders and suppliers to inventory a lesser number of pieces parts while retaining the ability to meet needs for either thin or thick wall applications.

The present description is for illustrative purposes only, and should not be construed to narrow the breadth of the present disclosure in any way. Thus, those skilled in the art will appreciate that various modification might be made to the presently disclosed embodiments without departing from the full and fair scope and spirit of the present disclosure. Other aspects, features and advantages will be apparent upon an examination of the attached drawings and appended claims.

ELEMENT LIST

10. tilt-form bracket
12. thin wall configuration
14. thick wall configuration
20. plastic shoe plate piece
21. slab contact surface
22. brace mating surface
23. mating groove
24. mating groove
25. left outside edge
26. right outside edge
27. upturned edge
28. upturned edge
29. edge
30. plastic triangle brace piece
31. plate mating surface
32. height extension mating surface
33. first triangle brace
34. second triangle brace
35. vertical wall
36. form connection through hole
37. first attachment wing
38. second attachment wing
39. side
40. side
41. form connection through hole
42. form connection through hole
43. dowel hole
44. locating slot
45. locating slot
46. form contact surface
50. plastic height extension piece
51. brace mating surface
52. brace extension
53. brace extension
54. wall extension
55. form connection through hole
56. form contact surface
57. locating dowel
60. snap fit connection

What is claimed is:

1. A tilt-form bracket for tilt up concrete wall construction comprising:

a one-piece plastic shoe plate having a slab contact surface opposite to a brace mating surface that includes a pair of spaced apart parallel mating grooves;

a one-piece plastic dual triangle brace that includes a plate mating surface and a height extension mating surface, and the plate mating surface including a pair of spaced apart parallel triangular braces separated by a vertical wall that defines a form connection through hole; and wherein the plate mating surface of the dual triangle brace mates with the brace mating surface of the shoe plate in exactly one configuration with each of the pair of spaced apart parallel triangular braces received in a respective one of the pair of spaced apart parallel mating grooves.

2. The tilt-form bracket of claim 1 wherein the one-piece plastic dual triangle brace includes first and second attachment wings that flank opposite sides of the pair of spaced apart parallel triangular braces;

each of the first and second attachment wings defines a form connection through hole that is outboard of respective left and right outside edges of the shoe plate.

3. The tilt-form bracket of claim 1 wherein the height extension mating surface includes each of the pair of spaced apart parallel triangle braces and the vertical wall define a plurality of dowel holes.

4. The tilt-form bracket of claim 1 wherein the one-piece plastic dual triangle brace includes first and second attachment wings that flank opposite sides of the pair of spaced apart parallel triangular braces; and each of the first and second attachment wings defines a locating slot that receives an upturned edge of the one-piece plastic shoe plate.

5. The tilt-form bracket of claim 1 including a one-piece plastic height extension that includes a brace mating surface and a pair of brace extensions connected by a wall extension that defines a form connection through hole;

the brace mating surface of the height extension mates in exactly one configuration with the height extension mating surface of the one-piece plastic dual triangle brace.

6. The tilt-form bracket of claim 5 wherein the one-piece plastic dual triangle brace includes first and second attachment wings that flank opposite sides of the pair of spaced apart parallel triangular braces;

each of the first and second attachment wings defines a form connection through hole that is outboard of respective left and right outside edges of the shoe plate.

7. The tilt-form bracket of claim 5 wherein the height extension mating surface includes each of the pair of spaced apart parallel triangle braces and the vertical wall define a plurality of dowel holes; and the brace mating surface of the height extension includes a plurality of locating dowels that are each received in a respective one of the dowel holes.

8. The tilt-form bracket of claim 5 wherein the one-piece plastic dual triangle brace includes first and second attachment wings that flank opposite sides of the pair of spaced apart parallel triangular braces; and each of the first and second attachment wings defines a locating slot that receives an upturned edge of the one-piece plastic shoe plate.

9. The tilt-form bracket of claim 8 wherein each of the first and second attachment wings defines a form connection through hole that is outboard of respective left and right outside edges of the one-piece plastic shoe plate.

10. The tilt-form bracket of claim 9 wherein the height extension mating surface includes each of the pair of spaced apart parallel triangle braces and the vertical wall define a plurality of dowel holes; and the brace mating surface of the height extension includes a plurality of locating dowels that are each received in a respective one of the dowel holes.

11. A tilt-form bracket for tilt up concrete wall construction consisting of exactly three pieces comprising:

a shoe plate piece;

a triangle brace piece that defines three form connection through holes;

a height extension piece that defines one form connection through hole; and the triangle brace piece is mounted on the shoe plate piece, and the height extension piece is mounted atop the triangle brace piece.

12. The tilt-form bracket of claim 11 wherein the triangle brace piece includes a pair of spaced apart parallel triangular braces separated by a vertical wall that defines one of the three form connection through holes.

13. The tilt-form bracket of claim 11 wherein the triangle brace piece includes first and second attachment wings;

each of the first and second attachment wings defines a form connection through hole that is outboard of respective left and right outside edges of the shoe plate and are two of the three hole connection through holes.

14. The tilt-form bracket of claim 11 wherein the triangle brace piece defines a plurality of dowel holes;

the height extension piece includes a plurality of locating dowels that are each received in a respective one of the plurality of dowel holes.

15. A tilt-form bracket for tilt up concrete wall construction consisting of exactly three pieces comprising:

a shoe plate piece;

a triangle brace piece that defines three form connection through holes;

a height extension piece that defines one form connection through hole; and the triangle brace piece is mounted on the shoe plate piece, and the height extension piece is mounted atop the triangle brace piece;

wherein the triangle brace piece includes first and second attachment wings; and each of the first and second attachment wings defines a locating slot that receives an upturned edge of the shoe plate piece.

16. The tilt-form bracket of claim 15 wherein each of the first and second attachment wings defines a form connection through hole that is outboard of respective left and right outside edges of the shoe plate and are two of the three hole connection through holes.

17. The tilt-form bracket of claim 15 wherein the triangle brace piece defines a plurality of dowel holes;

the height extension piece includes a plurality of locating dowels that are each received in a respective one of the plurality of dowel holes.

18. The tilt-form bracket of claim 15 wherein the triangle brace piece includes a pair of spaced apart parallel triangular braces separated by a vertical wall that defines one of the three form connection through holes.

19. The tilt-form bracket of claim 18 wherein each of the first and second attachment wings defines a form connection through hole that is outboard of respective left and right outside edges of the shoe plate and are two of the three hole connection through holes.

20. The tilt-form bracket of claim 19 wherein the triangle brace piece defines a plurality of dowel holes;

the height extension piece includes a plurality of locating dowels that are each received in a respective one of the plurality of dowel holes.

* * * * *